US009819121B2

(12) United States Patent
Masaki et al.

(10) Patent No.: US 9,819,121 B2
(45) Date of Patent: Nov. 14, 2017

(54) SCREWLESS TERMINAL BLOCK

(71) Applicant: OMRON CORPORATION, Kyoto-shi, Kyoto (JP)

(72) Inventors: Kenichiro Masaki, Kumamoto (JP); Keisuke Yano, Kikuchi (JP); Hiroshi Hashimoto, Kumamoto (JP); Yoshikazu Tajiri, Kikuchi (JP); Tomokazu Ikeda, Yamaga (JP); Shinya Tsuji, Yamaga (JP); Taijiro Fujiwara, Okayama (JP); Masahiro Ono, Okayama (JP); Masao Nagase, Okayama (JP); Yusuke Komoguchi, Okayama (JP)

(73) Assignee: OMRON CORPORATION, Kyoto-shi (JP)

( * ) Notice: Subject to any disclaimer, the term of this patent is extended or adjusted under 35 U.S.C. 154(b) by 0 days.

(21) Appl. No.: 15/382,842

(22) Filed: Dec. 19, 2016

(65) Prior Publication Data

US 2017/0256882 A1 Sep. 7, 2017

(30) Foreign Application Priority Data

Mar. 7, 2016 (JP) ..... 2016-043864

(51) Int. Cl.
*H01R 11/20* (2006.01)
*H01R 13/62* (2006.01)
(Continued)

(52) U.S. Cl.
CPC ..... *H01R 13/62* (2013.01); *H01R 4/4827* (2013.01); *H01R 9/2416* (2013.01)

(58) Field of Classification Search
CPC .. H01R 4/2433; H01R 4/2404; H01R 4/2412; H01R 4/40; H01R 4/2491; H01R 11/282
(Continued)

(56) References Cited

U.S. PATENT DOCUMENTS 5,494,456 A 2/1996 Kozel et al.
6,074,242 A 6/2000 Stefaniu et al.
(Continued)

FOREIGN PATENT DOCUMENTS

JP H05-073857 U 10/1993
JP 2000-251968 A 9/2000

OTHER PUBLICATIONS

The extended European search report issued Mar. 3, 2017 in the counterpart European patent application.
(Continued)

*Primary Examiner* — Phuongchi T Nguyen

(74) *Attorney, Agent, or Firm* — Metrolexis Law Group, PLLC

(57) ABSTRACT

A screwless terminal block allows easy insertion and removal of a wire. A housing (2) includes a fixture insertion opening (23) through which a rod-like fixture (6) is inserted to come in contact with a contact pressure spring (4) and deform the spring (4) away from a wire (5). When the fixture (6) is inserted through the fixture insertion opening (23), an acute angle of 45° or less is formed by an axis of the fixture (6) and a straight line connecting a contact point A between the housing (2) and a part of the fixture (6) adjacent to the wire insertion opening (24) and a contact point B between the housing (2) and a part of the fixture (6) adjacent to the spring (4) at a cross-section taken along a plane including the axis of the fixture (6) and parallel to a pressing direction of the spring (4).

7 Claims, 4 Drawing Sheets

(51) Int. Cl.
*H01R 4/48* (2006.01)
*H01R 9/24* (2006.01)

(58) Field of Classification Search
USPC ..... 439/409, 391, 410, 432–436, 387, 393
See application file for complete search history.

(56) References Cited

U.S. PATENT DOCUMENTS 6,746,286 B2 * 6/2004 Blaha ..... H01R 4/4809
439/436
6,796,830 B2 * 9/2004 Suss ..... H01R 4/2466
439/395
7,845,970 B2 * 12/2010 Stromiedel ..... H01R 4/4818
439/436

OTHER PUBLICATIONS

Korean Office Action dated Sep. 14, 2017 in the counterpart Korean application.

* cited by examiner

SCREWLESS TERMINAL BLOCK

FIELD

The present invention relates to a screwless terminal block.

BACKGROUND

Screwless terminal blocks known in the art allow connection of wires to terminal blocks without using screws.

For example, Patent Literature 1 describes a screwless terminal including a contact pressure spring for fixing wires and a release button. The screwless terminal described in Patent Literature 1 has its release button pressed using a screwdriver and then the release button presses the contact pressure spring to allow insertion and removal of the wires.

CITATION LIST

Patent Literature

Patent Literature 1: Japanese Unexamined Patent Application Publication No. 2000-251968 (published on Sep. 14, 2000)

SUMMARY

Technical Problem

However, the worker uses both hands when inserting or removing a wire into and from the screwless terminal described in Patent Literature 1. To insert or remove a wire, the worker holds a screwdriver on one hand and the wire on the other hand, and presses the release button using the screwdriver, and then inserts or removes the wire while pressing the release button. The worker then releases the release button to complete this operation. In this manner, the worker uses both hands when inserting or removing a wire into or from the screwless terminal described in Patent Literature 1. This work is difficult and complicated.

In response to the above issue, one or more aspects of the present invention are directed to a screwless terminal block that allows easy insertion and removal of a wire.

Solution to Problem

In response to the above issue, a screwless terminal block according to one aspect of the present invention includes a resin housing having a wire insertion opening through which a wire is to be inserted, and an internal wire accommodating space to accommodate the wire, and an elastic member that comes in contact with the wire inserted through the wire insertion opening and applies a force to the wire in a predetermined pressing direction to prevent the wire from coming off. The housing has a fixture insertion opening through which a rod-like fixture is to be inserted to come in contact with the elastic member and cause the elastic member to deform away from the wire accommodating space. When the fixture is inserted through the fixture insertion opening, an acute angle of 45° or less is formed by an axis of the fixture and a straight line connecting a point A and a point B at a cross-section taken along a plane that includes the axis of the fixture and is parallel to the predetermined pressing direction. The point A is a point of contact between the housing and a part of the fixture adjacent to the wire insertion opening. The point B is a point of contact between the housing and a part of the fixture adjacent to the elastic member.

The fixture receives a force from the elastic member to rotate about point A. However, the fixture, which is in contact with the housing at the point B, applies a force to the housing at the point B. The structure described above provides a longer distance between a plane X, which includes the point A and is perpendicular to the axial direction of the fixture, and the point B. This reduces the force at the point B applied from the fixture and received by the housing, and reduces distortion or deformation of the housing at the point B. Thus, the screwless terminal block can support the fixture in a stable manner at the points A and B, and the point of contact between the elastic member and the fixture. The insertion or removal of a wire is easy.

The screwless terminal block according to the aspect of the present invention may be any screwless terminal block that includes the housing and the elastic member described above, and may have various structures. For example, the screwless terminal block according to the embodiment may be an input and output unit including the housing and the elastic member described above and incorporated in a device such as a relay, a relay socket, a temperature regulator, or a power supply.

In the screwless terminal block according to another aspect of the present invention, the elastic member applies a force of 30 N or less to the fixture inserted through the fixture insertion opening.

The above structure allows the fixture to be inserted through the fixture insertion opening and to easily deform the elastic member.

In the screwless terminal block according to another aspect of the present invention, when the fixture is inserted through the fixture insertion opening, $c/b \leq 7/3$, where b is a distance between the point B and a plane X that includes the point A and is perpendicular to the axis of the fixture, and c is a distance between the plane X and a point C that is a point of contact between the fixture and the elastic member.

The above structure allows the pressure at the point B applied from the fixture and received by the housing to be equal to or less than the compressive strength of the resin used for the housing, and further reduces distortion or deformation of the housing at the point B. This allows the screwless terminal block to support the fixture in a more stable manner.

A screwless terminal block according to another aspect of the present invention includes a resin housing having a wire insertion opening through which a wire is to be inserted, and an elastic member that comes in contact with the wire inserted through the wire insertion opening and apply a force to the wire in a predetermined pressing direction to prevent the wire from coming off. The housing has a fixture insertion opening through which a rod-like fixture is to be inserted to come in contact with the elastic member and deform the elastic member away from the wire. When the fixture is inserted through the fixture insertion opening, $c/b \leq 70/Fc$ at a cross-section taken along a plane that includes an axis of the fixture and is parallel to the predetermined pressing direction, where b is a distance between a point B and a plane X that includes a point A and is perpendicular to the axis of the fixture, c is a distance between the plane X and a point C, and Fc (N) is a force applied from the elastic member and received by the fixture, and the point A is a point of contact between the housing and a part of the fixture adjacent to the wire insertion opening, the point B is a point of contact between the housing and a part of the fixture adjacent to the elastic member, and the point C is a point of contact between the fixture and the elastic member.

The above structure allows the pressure at the point B applied from the fixture and received by the housing to be equal to or less than the compressive strength of the resin used for the housing, and reduces distortion or deformation of the housing at the point B. This allows the screwless terminal block to support the fixture in a more stable manner. The screwless terminal block can support the fixture in a stable manner at the points A and B, and the point of contact between the elastic member and the fixture. Thus, the insertion or removal of a wire is easy.

In the screwless terminal block according to another aspect of the present invention, the housing has a curved surface with a curvature of an outer periphery of the fixture, and the point B is included in the curved surface.

The above structure reduces the pressure at the point B to be applied by the fixture to the housing, and further reduces distortion or deformation of the housing at the point B. Thus, the screwless terminal block can support the fixture in a more stable manner.

Advantageous Effects

The screwless terminal block according to one or more embodiments of the present invention allows easy insertion or removal of wires.

DETAILED DESCRIPTION

Embodiments of the present invention will now be described in detail with reference to the drawings.

Figure 1:
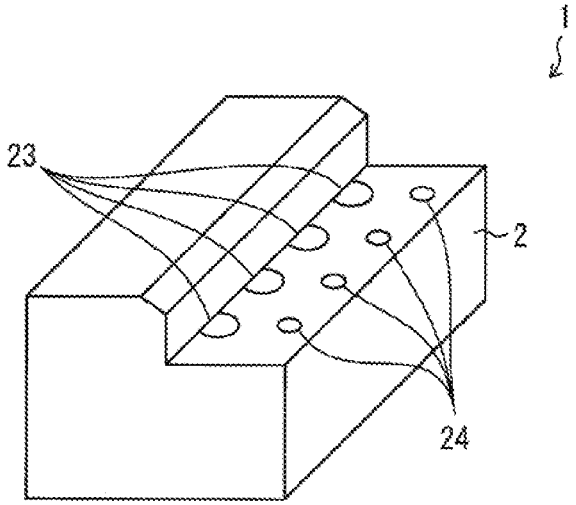
FIG. 1 is a schematic perspective view of a screwless terminal block according to an embodiment of the present invention.

FIG. 1 is a schematic perspective view of a screwless terminal block 1 according to an embodiment of the present invention. As shown in FIG. 1, the screwless terminal block 1 includes a housing 2. The housing 2 has wire insertion openings 24, through which wires are to be inserted, and fixture insertion openings 23, through which fixtures are to be inserted when the wires are inserted or removed. As shown in FIG. 1, the screwless terminal block 1 according to the present embodiment has four pairs of wire insertion openings 24 and fixture insertion openings 23. However, the numbers of wire insertion openings 24 and fixture insertion openings 23 are not limited to these.

Although the screwless terminal block 1 shown in FIG. 1 is separate from other parts, the screwless terminal block according to the embodiment is not limited to this structure. For example, the screwless terminal block according to the embodiment may be a terminal block as an input and output unit incorporated in a device such as a relay, a relay socket, a temperature regulator, or a power supply.

Figure 2:
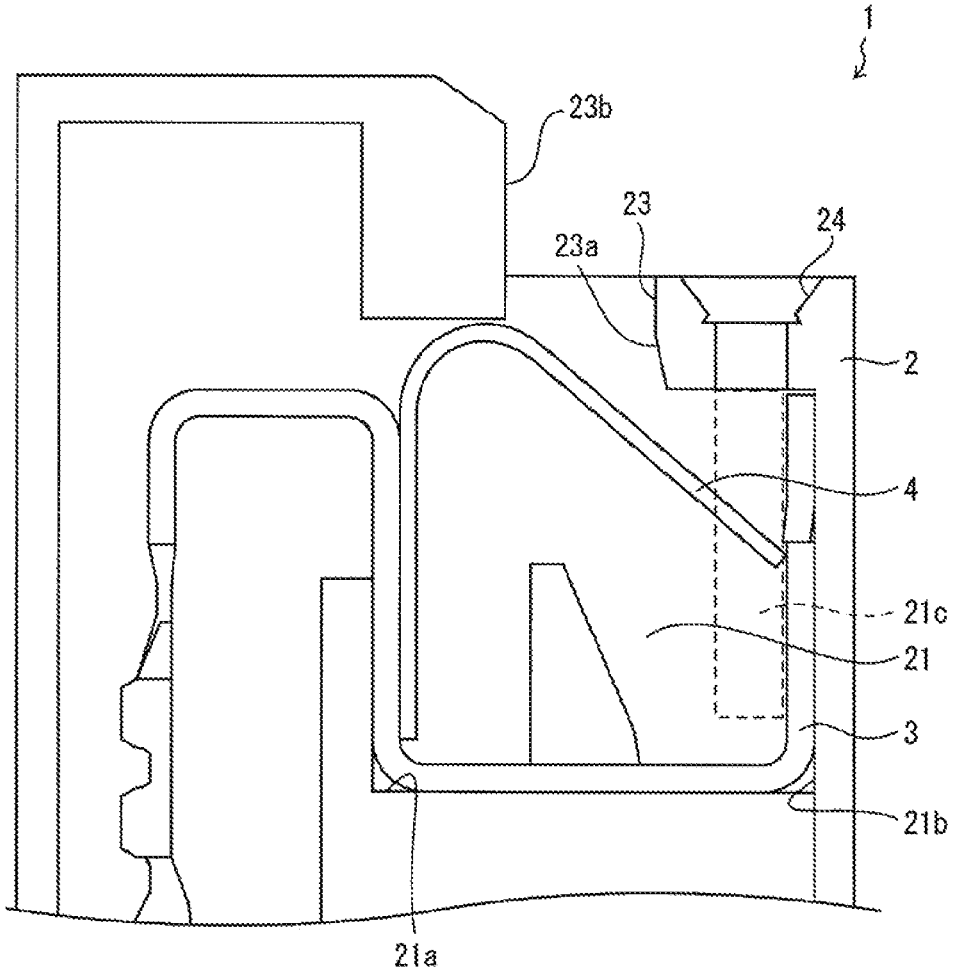
FIG. 2 is a cross-sectional view of the screwless terminal block shown in FIG. 1 with no wire being inserted.
Figure 3:
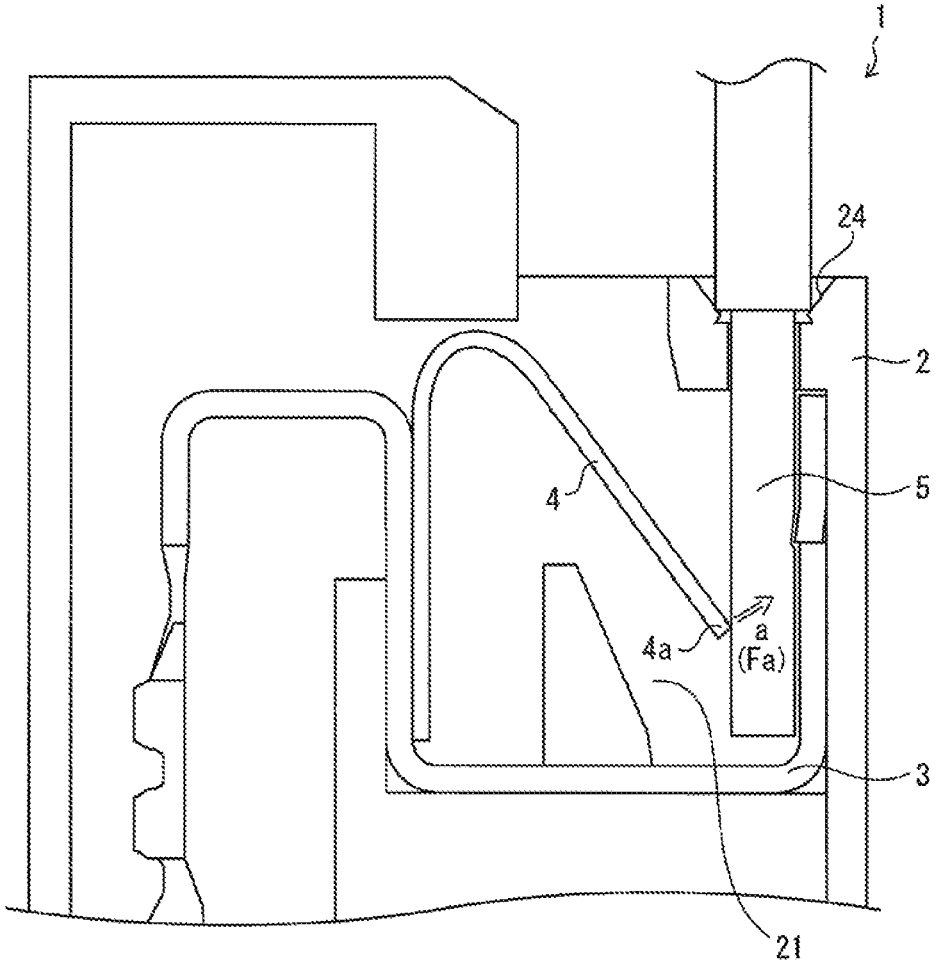
FIG. 3 is a cross-sectional view of the screwless terminal block shown in FIG. 1 with a wire being inserted.
Figure 4:
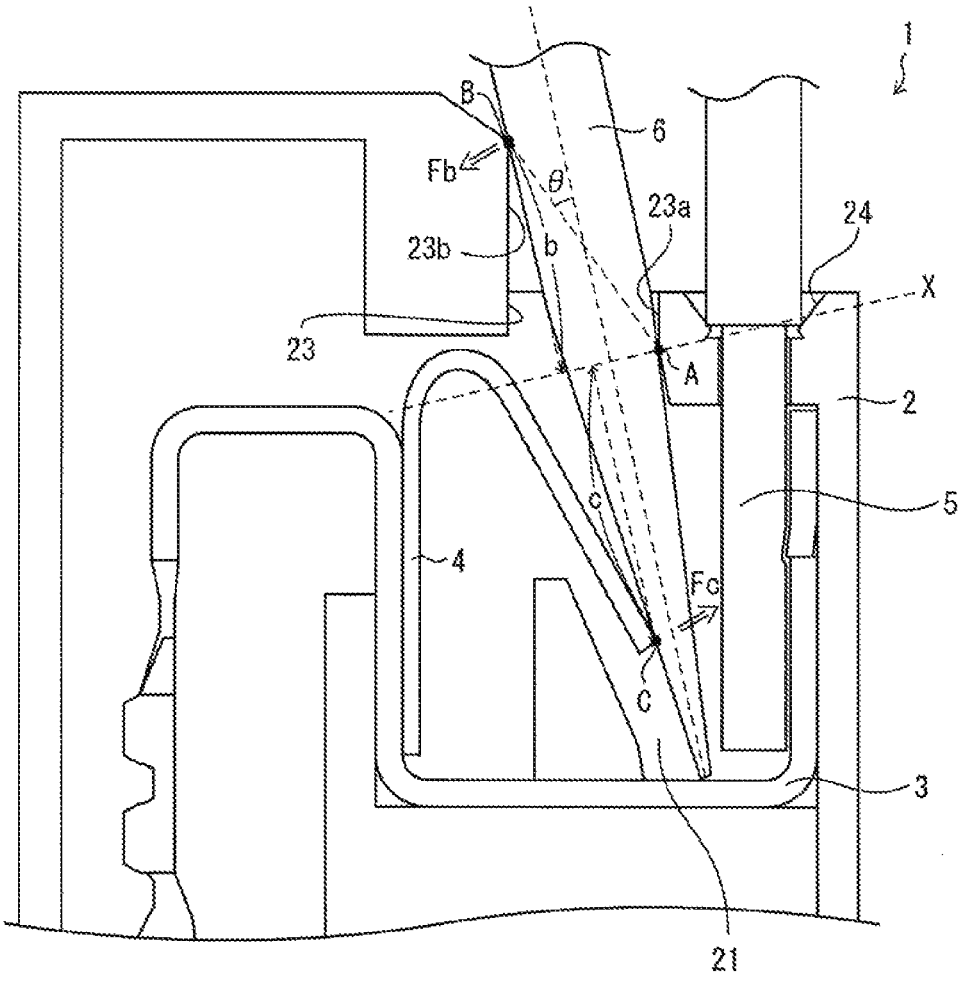
FIG. 4 is a cross-sectional view of the screwless terminal block shown in FIG. 1 with a fixture being inserted.

FIGS. 2 to 4 are cross-sectional views of the screwless terminal block 1 taken along a plane including one pair of the wire insertion opening 24 and the fixture insertion opening 23. FIG. 2 shows the screwless terminal block 1 with no wire 5 being inserted, whereas FIG. 3 shows the screwless terminal block 1 with a wire 5 being inserted. FIG. 4 shows the screwless terminal block 1 with a fixture 6 being inserted for allowing insertion or removal of the wire 5. For ease of explanation herein, the direction in which the wire 5 is inserted is downward, and the direction in which the wire 5 is removed is upward.

The screwless terminal block 1 includes a housing unit 21 in the housing 2. The housing unit 21 includes a terminal base 3 and a contact pressure spring 4.

The housing 2 is formed from a resin, such as modified polyphenylene ether (PPE) or polyamide 66 (PA66). The housing 2 has the fixture insertion openings 23 and the wire insertion openings 24 as described above.

As shown in FIG. 4, the fixture insertion opening 23 is a hole communicating with the housing unit 21, through which a rod-like fixture 6 is inserted for inserting or removing the wire 5. The fixture 6 may be, for example, a slotted screwdriver.

The wire insertion opening 24 is a hole communicating with the housing unit 21, through which the wire 5 is inserted into the housing unit 21 in the housing 2. The housing unit 21 in the housing 2 has a wire accommodating space 21*c* under the wire insertion opening 24. The wire accommodating space 21*c* accommodates the wire 5 inserted through the wire insertion opening 24.

The terminal base 3 is formed from a conductor. The terminal base 3 electrically connects to the wire 5 when the wire 5 is inserted. The terminal base 3 has a substantially U-shaped cross-section, and is arranged to come in contact with a bottom surface 21*a* and a side surface 21*b* of the housing unit 21.

The contact pressure spring 4 is an elastic leaf spring. As shown in FIG. 3, the contact pressure spring 4 presses the wire 5 against the terminal base 3 with a biasing force when the wire 5 is inserted. In the present embodiment, the tip end 4*a* of the contact pressure spring 4 comes in contact with the wire 5, and applies a force Fa in a pressing direction, which is direction a, to the wire 5. The wire 5 inserted through the wire insertion opening 24 is retained between the terminal base 3 and the contact pressure spring 4 and is prevented from coming off from the terminal block.

The pressure spring 4 may have a shape different from the shape shown in FIGS. 2 to 4. For example, the contact pressure spring 4 may have a curved portion adjacent to its tip end, and the curved portion may come in contact with the wire 5 and apply the force Fa in the pressing direction a.

The screwless terminal block 1 according to the present embodiment can support the fixture 6 when the fixture 6 is inserted, without the worker holding the fixture 6. This structure will now be described with reference to FIG. 4.

When the worker inserts the fixture 6 into the housing unit 21 through the fixture insertion opening 23, the tip end of the fixture 6 comes in contact with the contact pressure spring 4. The worker further inserts the fixture 6 while compressing (or deforming) the contact pressure spring 4 away from the wire 5 (or from the wire accommodating space 21*c* when no wire 5 is inserted) until the fixture 6 comes in contact with the terminal base 3, which is in contact with the bottom surface 21*a* of the housing unit 21. When the worker removes his or her hand from the fixture 6 in this state, the fixture 6 tilts under the biasing force of the contact pressure spring 4. In this state, the fixture 6 is in contact with and supported by the screwless terminal block 1 at three points, or one point on the pressure spring 4 and two points on the wall surfaces of the fixture insertion opening 23 in the housing 2.

At the cross-section shown in FIG. 4 taken along a plane including the axis of the rod-like fixture 6 and parallel to the pressing direction a of the contact pressure spring 4, the fixture 6 comes in contact with a point A, which is on a wall 23*a* adjacent to the wire insertion opening 24, and a point B, which is on a wall 23*b* adjacent to the contact pressure spring 4, among the walls defining the fixture insertion opening 23 in the housing 2, and a point C on the contact pressure spring 4. In other words, the fixture 6 is in contact with the housing 2 at the point A adjacent to the wire insertion opening 24, and at the point B adjacent to the contact pressure spring 4.

The inventors have noticed that the resin housing 2 receives an excessive force from the fixture 6 at the contact points between the housing 2 and the fixture 6 when the fixture 6 is supported at the three points, and may distort or deform to destabilize supporting of the fixture 6. The inventors have then conceived the structure according to the embodiment.

To achieve more stable supporting of the fixture 6 at the three points, the walls 23*a* and 23*b* defining the fixture insertion opening 23 in the housing 2 are designed to have an acute angle of 45° or less, or 40° or less between the axis of the rod-like fixture 6 and the straight line connecting the points A and B.

As shown in FIG. 4, when the fixture 6 is inserted into the fixture insertion opening 23, the contact pressure spring 4 applies a force Fc to the fixture 6 in substantially the same direction as the pressing direction a (specifically, the direction toward the wire 5). The surface of the fixture 6 adjacent to the wire insertion opening 24 comes in contact with the housing 2 at the point A to cause the fixture 6 to rotate about the point A. However, the surface of the fixture 6 adjacent to the contact pressure spring 4 is in contact with the housing 2 at the point B. In response to the force Fc applied to the fixture 6 at the point C, the fixture 6 applies a force Fb to the housing 2 at the point B. The housing 2 is formed from a resin, and thus may distort or deform when receiving, at the point B, a pressure larger than the compressive strength of the resin. The distortion or deformation of the housing 2 may destabilize supporting of the fixture 6 at the points A, B, and C, and may cause the fixture 6 to come off easily from the screwless terminal block 1. In this case, the worker is not allowed to remove his or her hand from the fixture 6 while inserting or removing the wire. This work is difficult and complicated.

In contrast, the housing 2 according to the present embodiment is designed to have an acute angle of 45° or less, or 40° or less between the axis of the rod-like fixture 6 and the straight line connecting the points A and B. This structure provides a longer distance between a plane X, which includes the point A and is perpendicular to the axial direction of the fixture 6, and the point B (in other words, the length of the perpendicular line from the point B to the plane X). The force Fb to be applied to the housing 2 at the point B (wall 23*b*) can be calculated approximately using the formula $Fb=Fc\times(c/b)$, using the distance b between the plane X and the point B, and the distance c between the plane X and the point C (specifically, the perpendicular line from the point C to the plane X). Thus, the distance b between the plane X and the point B may be set longer to reduce the force Fb, which presses the housing 2 at the point B. The longer distance between the plane X and the point B thus reduces distortion or deformation of the housing 2 at the point B. The screwless terminal block 1 can support the fixture 6 in a stable manner at the points A, B, and C. The worker is allowed to remove his or her hand from the fixture 6 when inserting or removing the wire 5. This work is easy.

In one example, a slotted screwdriver with a shaft diameter of 2.5 mm is used as the fixture 6, the force Fc applied to the fixture 6 by the contact pressure spring 4 is set equal to or less than 30 N, and the distance c between the plane X and the point C is set at 5.8 mm. When typical modified PPE or typical PA66 is used as a resin for the housing 2, the compressive strength is in a range of 70 to 90 MPa. In this case, the force Fb (N) to be applied to the housing 2 at the point B is $30\times(5.8/b)$ at the maximum. Assuming that the force Fb is applied to an area of 1 $mm^2$, the pressure (MPa) is $30\times(5.8/b)$ at the point B. To maintain the pressure to be equal to or less than the compressive strength of the resin used for the housing 2, the inequality $30\times(5.8/b)\leq 70$ is to be satisfied, and thus $b\geq 2.5$. An angle θ formed by the straight line connecting the points A and B and the axis of the fixture 6 is written as $\theta\leq a\tan$ (the minimum value of 2.5 of the shaft diameter of 2.5/b of the fixture 6)≈45°. Thus, with the acute angle of 45° or less between the straight line connecting the points A and B and the axis of the rod-like fixture 6, the pressure to be applied at the point B can be equal to or less than the compressive strength of the resin used for the housing 2.

In another example, a slotted screwdriver with a shaft diameter of 2.5 mm is used as the fixture 6, the force Fc applied to the fixture 6 by the contact pressure spring 4 is set equal to or less than 27 N, and the distance c between the plane X and the point C is set at 7.7 mm. In this case, the force Fb (N) to be applied to the housing 2 at the point B is $27\times(7.7/b)$ at the maximum. Assuming that the force Fb is applied to an area of 1 $mm^2$, the pressure (MPa) is $27\times(7.7/b)$ at the point B. To maintain this pressure to be equal to or less than the compressive strength of the resin used for the housing 2, the inequality $27\times(7.7/b)\leq 70$ is to be satisfied, and thus $b\geq 3.0$. An angle θ formed by the straight line connecting the points A and B and the axis of the fixture 6 is written as $\theta\leq a\tan$ (the minimum value of 3.0 of the shaft diameter of 2.5/b of the fixture 6)≈40°. Thus, with the acute angle of 40° or less between the straight line connecting the points A and B and the axis of the rod-like fixture 6, the pressure to be applied at the point B can be equal to or less than the compressive strength of the resin used for the housing 2.

In this manner, the components of the screwless terminal block 1 in the present embodiment are set to allow the pressure applied at the point B to be equal to or less than the compressive strength of the resin used for the housing 2. In other words, the structure according to the embodiment of the present invention is designed to satisfy the inequality $Fc\times(c/b)\leq 70$, where b is the distance between the point B and the plane X, which includes the point A and is perpendicular to the axial direction of the fixture 6, c is the distance between the plane X and the point C, and Fc is the force applied to the fixture 6 by the contact pressure spring 4. The force Fc may be 30 N or less to allow insertion or removal of the fixture 6, and thus $c/b\leq 70/30$.

The housing 2 may have a curved surface having the curvature of the outer periphery of the fixture 6 around the point B. This allows the point B to be included in the curved surface, and allows the force applied by the fixture 6 to be received by the entire curved surface with a larger area than the area of the point B. This lowers the pressure at the point B.

The embodiments disclosed herein should not be construed to be restrictive, but may be modified within the spirit and scope of the claimed invention. The technical features disclosed in different embodiments may be combined in other embodiments within the technical scope of the invention.

REFERENCE SIGNS LIST

1 terminal block
2 housing
3 terminal base
4 contact pressure spring (elastic member)
5 wire
6 fixture
21*c* wire accommodating space
23 fixture insertion opening
24 wire insertion opening

The invention claimed is:

1. A screwless terminal block, comprising:

a resin housing having a wire insertion opening through which a wire is to be inserted, and an internal wire accommodating space configured to accommodate the wire; and an elastic member configured to come in contact with the wire inserted through the wire insertion opening and apply a force to the wire in a predetermined pressing direction to prevent the wire from coming off, the housing having a fixture insertion opening through which a rod-like fixture is to be inserted to come in contact with the elastic member and deform the elastic member away from the wire accommodating space, wherein when the fixture is inserted through the fixture insertion opening, an acute angle of 45° or less is formed by an axis of the fixture and a straight line connecting a point A and a point B at a cross-section taken along a plane that includes the axis of the fixture and is parallel to the predetermined pressing direction, where the point A is a point of contact between the housing and a part of the fixture adjacent to the wire insertion opening, and the point B is a point of contact between the housing and a part of the fixture adjacent to the elastic member.

2. The screwless terminal block according to claim 1, wherein the elastic member is configured to apply a force of 30 N or less to the fixture inserted through the fixture insertion opening.

3. The screwless terminal block according to claim 2, wherein the housing has a curved surface with a curvature of an outer periphery of the fixture, and the point B is included in the curved surface.

4. The screwless terminal block according to claim 2, wherein when the fixture is inserted through the fixture insertion opening, $c/b \leq 7/3$, where b is a distance between the point B and a plane X that includes the point A and is perpendicular to the axis of the fixture, and c is a distance between the plane X and a point C that is a point of contact between the fixture and the elastic member.

5. The screwless terminal block according to claim 4, wherein the housing has a curved surface with a curvature of an outer periphery of the fixture, and the point B is included in the curved surface.

6. A screwless terminal block, comprising:

a resin housing having a wire insertion opening through which a wire is to be inserted; and an elastic member configured to come in contact with the wire inserted through the wire insertion opening and apply a force to the wire in a predetermined pressing direction to prevent the wire from coming off, the housing having a fixture insertion opening through which a rod-like fixture is to be inserted to come in contact with the elastic member and deform the elastic member away from the wire, wherein when the fixture is inserted through the fixture insertion opening, $c/b \leq 70/Fc$ at a cross-section taken along a plane that includes an axis of the fixture and is parallel to the predetermined pressing direction, where b is a distance between a point B and a plane X that includes a point A and is perpendicular to the axis of the fixture, c is a distance between the plane X and a point C, and Fc (N) is a force applied from the elastic member and received by the fixture, and the point A is a point of contact between the housing and a part of the fixture adjacent to the wire insertion opening, the point B is a point of contact between the housing and a part of the fixture adjacent to the elastic member, and the point C is a point of contact between the fixture and the elastic member.

7. The screwless terminal block according to claim 1, wherein the housing has a curved surface with a curvature of an outer periphery of the fixture, and the point B is included in the curved surface.

* * * * *